United States Patent [19]

Shafai

[11] Patent Number: 4,947,178

[45] Date of Patent: Aug. 7, 1990

[54] SCANNING ANTENNA

[76] Inventor: Lotfollah Shafai, 604 Kilkenny Drive, Winnipeg, Manitoba, Canada, R3T 3E1

[21] Appl. No.: 189,012

[22] Filed: May 2, 1988

[51] Int. Cl.[5] ..... H01Q 1/38; H01Q 3/34

[52] U.S. Cl. ..... 343/700 MS; 343/769; 342/368

[58] Field of Search ..... 343/700 MS, 769, 846, 343/853; 342/368, 371, 372

[56] References Cited

U.S. PATENT DOCUMENTS

| | | | |
|---|---|---|---|
| 4,320,402 | 3/1982 | Bowen | 343/700 MS |
| 4,329,689 | 5/1982 | Yee | 343/700 MS |
| 4,414,550 | 11/1983 | Tresselt | 343/700 MS |

FOREIGN PATENT DOCUMENTS

| | | | |
|---|---|---|---|
| 141007 | 8/1983 | Japan | 343/700 MS |
| 2005922 | 4/1979 | United Kingdom | 343/700 MS |

OTHER PUBLICATIONS

Bhattacharya et al., IEEE Trans. on Antennas and Prop., vol. AP-33, No. 6, 6/85, pp. 655-659.

*Primary Examiner*—Michael C. Wimer
*Attorney, Agent, or Firm*—Sim & McBurney

[57] ABSTRACT

A novel scanning array antenna is provided with improved gain characteristic which enable a compact form to be employed. The resonant azimuthal modes of separate antenna elements are selected to satisfy certain mathematical relationships which, in effect, form a directional beam which can be steered by a relatively small number of phase shifters. An example of antenna structure is an array of circular microstrip patch in the form of concentric disks each in resonance at one of the azimuthal modes under the disk cavity.

6 Claims, 2 Drawing Sheets

SCANNING ANTENNA

FIELD OF INVENTION

The present invention relates to scanning antenna for a variety of communications.

BACKGROUND TO THE INVENTION

Phased antenna arrays are commonly used to scan an antenna beam electronically. The array normally consists of several antenna elements, such as dipoles or slots, waveguides or horns, and microstrip antennas or other printed configurations. In such arrays, the direction of the array beam can be steered electronically by introducing proper phase shifts to the input excitation of individual elements. Such phase shifting can be achieved using one active phase shift network for each element.

The configurations of the array depend on the application to which the antenna is put and, in principle, can be designed to provide any beam scanning capability, but, as a practical matter, difficulties arise. One of the significant problems with existing phased arrays is the cost of the antenna and its beamforming network.

The beamforming network consists of power dividers which provide the required power level to each antenna element and phase shifters which generate the phase shifts for beam scanning. In medium-to-high power applications, in particular, for dual or multifrequency applications, digital phase shifters are used to eliminate the intermodular distortion.

When the array must be scanned in small angular steps and over a large region of space, multiple bit phase shifters are needed, which increases the antenna cost and insertion loss. The overall beamforming network then becomes too complex and expensive to implement.

A second problem with existing phase arrays results from the insertion loss of the beamforming network, which increases with the array size and higher bit states of the phase shifters. These losses decrease the gain of the array and limit the peak achievable gain for large or highly-scanned arrays. Additional difficulties arise from the complexity of the beam scanner to control the phase states.

The present invention seeks to overcome these prior art problems and to provide a phased scanning antenna which operates satisfactorily yet does so at decreased cost and complexity and decreased insertion losses.

A search of the prior art has been conducted in the United States Patent and Trademark Office for patents relevant to the principles of the present invention. As a result of that search, the following U.S. Pat. Nos. have been noted as the most relevant: 3,541,557, 4,070,676, 4,415,900, 3,713,162, 4,089,003, 4,521,781, 3,739,386, 4,218,682, 4,605,932, 3,803,623, 4,320,402, 3,811,128, 4,379,296, It is believed that none of this prior art discloses the principles of the invention described herein.

SUMMARY OF INVENTION

In accordance with the present invention, there is provided a novel scanning antenna in which the resonant modes of a plurality of antenna elements making up the antenna are used to generate a directional beam from each antenna and phase shift means is associated with the plurality of antenna elements to steer a combined antenna beam.

The scanning antenna of the present invention may be used to effect transmission or receipt of electromagnetic energy along an axis which can be selected by an operator. In the transmission mode, a beam can be projected essentially in any desired direction while, in the receiving mode, the antenna can be made responsive to signals received only along a selectable axis and may be used to determine the location of the source of a transmission by scanning. The antenna may be maintained at a fixed location or may be mounted on a vehicle or the like for mobility.

DESCRIPTION OF PREFERRED EMBODIMENTS

Figure 1:
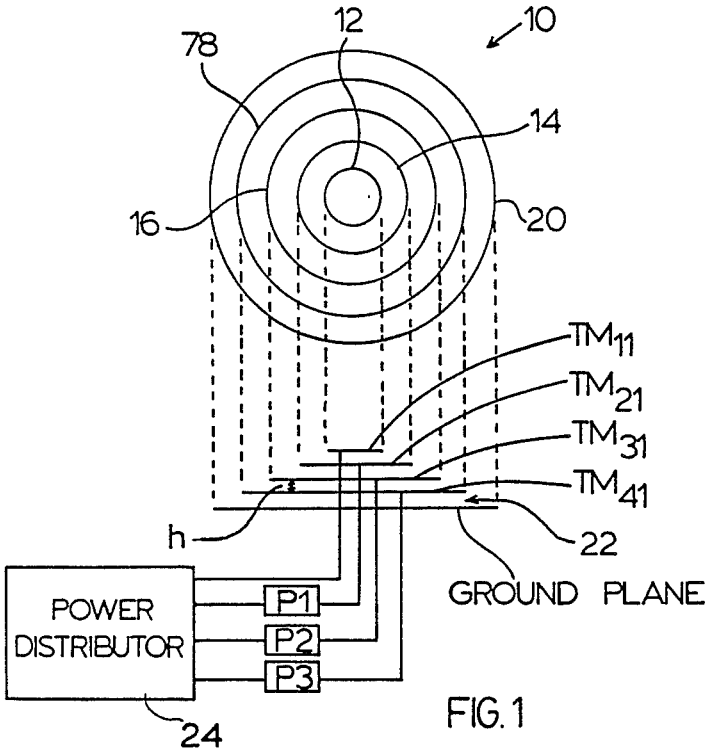
FIG. 1 is a schematic representation of a scanning antenna provided in accordance with one embodiment of the invention, shown in both plan and side view.

Referring to FIG. 1, there is illustrated an embodiment of a scanning antenna 10 in the form of coaxial conductive circular disks. A plurality of disks 12, 14, 16 and 18, which may be circular microstrip patches, are spaced apart and coaxially aligned and located over a conductive ground plane 20. The spacing 22 between the disks may be filled by a suitable dielectric material of relative permittivity $\epsilon_r$, that is low loss at microwave frequencies. Each circular patch forms a resonant cavity with one immediately below itself and the azimuthal $TM_{nm}$ modes under each individual patch 12, 14, 16 or 18 resonate when the patch radius a satisfies the relationship:

$$a_e = a\left[1 + \frac{2h}{\pi a \epsilon_r}\left(\ln\frac{\pi a}{2h} + 1.7726\right)\right]^{\frac{1}{2}}$$

where $a_e$ is the patch effective radius, h is the spacing between two adjacent disks and the effective radius $a_e$ is calculated from $$a_e = \frac{K_{mn}}{2\pi\sqrt{\epsilon_r}}$$

where $K_{mn}$ is the mth zero of the derivative of the Bessel function of order n.

In the configuration of FIG. 1, the upper disk 12 resonates at the azimuthal mode $TM_{11}$. The lower disks 14, 16 and 18 resonate progressively at higher modes $TM_{21}$, $TM_{31}$ and $TM_{41}$, respectively. In the transmission mode, a power divider or distributor 24 distributes an outgoing signal among the various antenna disks 12 to 18. Phase shifters $P_1$, $P_2$ and $P_3$ permit the relative phase of each of the divided components to be adjusted. The phase relationships are so adjusted that signal strength drops markedly, except along a predetermined axis. The axis can be shifted to focus the direction of the transmitted beam, by adjusting the phase shift introduced by phase shifters $P_1$ to $P_3$. In analogous manner, the phase shifters may be used to permit signals to be received only along a particular axis.

Circular polarization of the antenna 10 can be generated by feeding each patch at two different locations, separated angularly by $\phi=\pi/2n$ and fed at phase quadrature. The excitations may be handled using coaxial probes or microstrip lines, as is well known.

Figure 2:
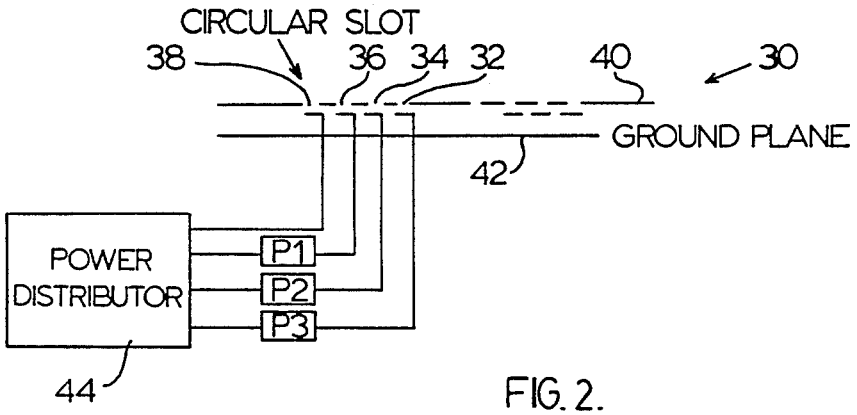
FIG. 2 is a schematic side view representation of a scanning antenna provided in accordance with another embodiment of this invention.

In the embodiment of FIG. 2, the scanning antenna 30 is in the form of circular slots 32, 34, 36 and 38 formed in a large disk 40 and separated from a reflecting plane 42. Concentric loops also may be used as the radiating or receiving components. The antennas 32, 34, 36 and 38 resonate at different azimuthal modes when their circumference is an integer multiple of the frequency wavelength. Circular polarization again is generated by feeding the antenna at two angular locations from a power source 44 and phase shifters $P_1$ to $P_3$. Circular polarization also may be generated using a geometrical perturbation, as is known in the art.

The antennas shown in FIGS. 1 and 2 are examples of circular antenna configurations which provide the needed radiation patterns with good ellipticity ratios for the circular polarization. However, other microstrip or antenna configurations may be used to achieve similar performance, within the general principle of structure and operation of the devices of FIGS. 1 and 2. For example, when the spacing between slots in FIG. 2 is increased, the microstrip annular slot antenna is obtained that can also generate the needed patterns. In general any antenna that generates $2n\pi$ radians of phase shifts along its periphery can generate the needed patterns.

For the antennas of FIGS. 1 and 2, the radiated circular polarized field for the nth mode can be expressed in the form:

$$E_\theta=f_n(\theta)e^{jn\phi}$$

$$E_\phi=g_n(\theta)e^{jn\phi}$$

where $f_n(\theta)$ and $g_n(\theta)$ are the $\theta$-dependent expressions of the radiated field.

For $n=1$, the radiation peak is along the $\theta=0$ direction and for $n>1$, the radiated field is conical in shape and produces a null along the $\theta=0$ direction. As n increases, the beam peak moves towards larger $\theta$ values.

Figure 3:
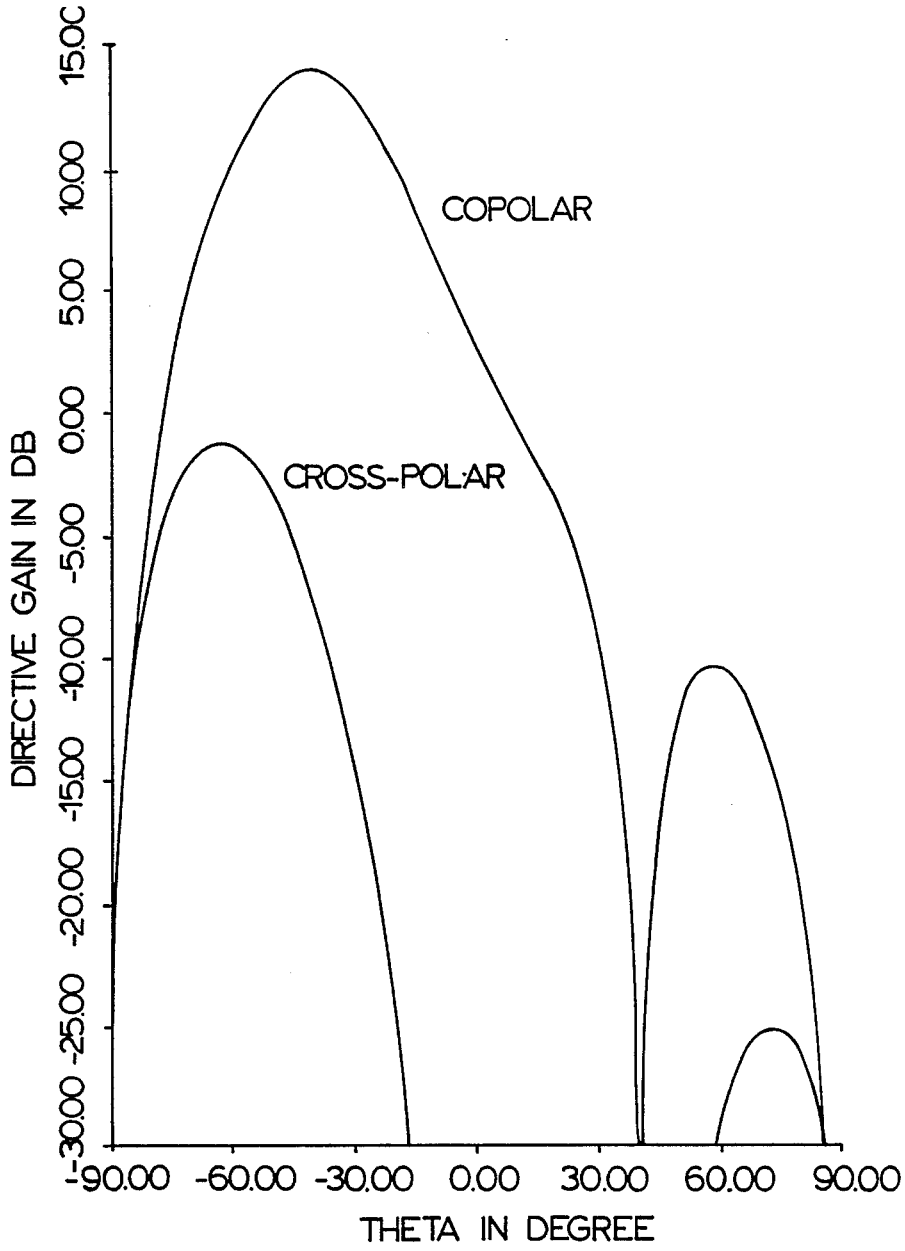
FIG. 3 is a typical directional array pattern for a scanning antenna of the type illustrated in FIG. 1, operating with six different azimuthal modes.

When the array consists of N elements operating in $n=1,2,3, \ldots N$ modes, the total radiated field can be expressed in the form:

$$E_\theta = \sum_{n=1}^{N} f_n(\theta)e^{jn\phi}$$

$$E_\phi = \sum_{n=1}^{N} g_n(\theta)e^{jn\phi}$$

where $E_\theta$ and $E_\phi$ components generate circularly-polarized vectors that may be right-handed or left-handed, depending on the excitation configuration. FIG. 3 shows a typical directional array pattern for the scanning antenna of FIG. 1, operating with six different azimuthal modes, that is $n=1,2,3,4,5$ and 6.

To scan the array beam, phase shifts are introduced between the excitations of different modes. The resulting far field patterns are of the form determined by the expressions:

$$E_\theta = \sum_{n=1}^{N} f_n(\theta)e^{jn\phi-j\delta_n}$$

$$E_\phi = \sum_{n=1}^{N} g_n(\theta)e^{jn\phi-j\delta_n}$$

δwhere $\delta_n$ is the phase introduced at the excitation of each mode. It follows from these expressions that, when $\phi=\delta_n/n$, the array field maximizes, since the exponential terms become unity. By introducing phase shift values of 0, $\delta_2$, $2\delta_2$, $3\delta_2 \ldots$ at the excitation inputs, the array beam can be scanned to the direction of $\phi=\delta_2$.

A relatively simple manner of generating and scanning of direction beams is provided, since a relatively good gain can be obtained by using a small number of antennas and hence a correspondingly small number of phase shifters. Since the required phase shift values increase with the mode number, only one higher bit phase shifter is necessary and the cost and insertion loss of the beam-forming network consequently is low.

The novel scanning antenna system of the invention is useful in many applications and may be used alone or as a plurality of such devices. One such application of the device is in mobile satellite communication, where the low angle array beams can be generated readily and scanned with a relatively small number of simple phase shifters.

By having each of antenna components responsive to a different mode, the novel scanning antenna of the invention results in significantly less power loss than in a conventional scanning antenna having a similar number of components, when signal phase relationship are appropriately selected for beam forming. With fewer antenna components and phase shifters required for a given gain, the cost of the antenna is significantly decreased.

SUMMARY OF DISCLOSURE

In summary of this disclosure, the present invention provides a novel scanning antenna which, by virtue of the specific mathematical relationship inherent in its structure, is particularly powerful and cost effective. Modifications are possible within the scope of this invention.

What I claim is:

1. A scanning antenna, which comprises:

a plurality of concentric antenna elements arranged in resonant modes so that each resonates at a different azimuthal mode and is functional to produce a radiated circular polarized field, and phase shift means operatively connected to said plurality of antenna elements to effect phase shifts between azimuthal modes so as to steer a combined antenna beam consisting of the individual beams provided by each antenna element, said field for the nth mode of said elements being expressed by the relationships:

$$E_\theta=f_n(\theta)e^{jn\phi}$$

$$E_\phi=g_n(\theta)e^{jn\phi}$$

where $f_n(\theta)$ and $g_n(\theta)$ are the $\theta$-dependent expressions of the radiated field, whereby for $n=1$, the radiation peak is along the $\theta=0$ direction and for $n>1$, the radiated field is conical in shape and produces a null along the $\theta=0$ direction, and as n increases, the beam peak moves towards larger $\theta$ values.

2. A scanning antenna, which comprises: N antenna elements each of which resonates at a different azimuthal mode n and is functional to produce a radiated circular polarized field wherein said field for the nth mode of said elements is expressed by the relationships:

$$E_\theta = f_n(\theta)e^{jn\phi}$$

$$E_\phi = g_n(\theta)e^{jn\phi}$$

and the total radiated field of the antenna is expressed by the relationships:

$$E_\theta = \sum_{n=1}^{N} f_n(\theta)e^{jn\phi}$$

$$E_\phi = \sum_{n=1}^{N} g_n(\theta)e^{jn\phi}$$

where $f_n(\theta)$ and $g_n(\theta)$ are the $\theta$-independent expressions of radiated field, whereby for $n=1$, the radiation peak is along the $\theta=0$ direction and for $n>1$, the radiated field is conical in shape and produces a null along the $\theta=0$ direction, and as n increases, the beam peak moves towards larger $\theta$ values, and phase shift means operatively connected to said N antenna elements to steer a combined beam.

3. The antenna of claim 2 wherein said antenna elements comprise a ground plane and a plurality of concentric circular microstrip patches, each arranged in the form of a resonant cavity and having effective radii $a_e$ corresponding to the relationship:

$$a_e = \frac{K_{mn}}{2\pi\sqrt{\epsilon_r}}$$

where $K_{mn}$ is the mth zero of the derivative of the Bessel function of order n and $\epsilon_r$ is the relative-permitivity of the material filling a space under each microstrip patch and wherein said microstrip patches resonate at different azimuthal modes $n=1,2,3, \ldots N$ to generate their respective radiation patterns.

4. The antenna of claim 3 wherein each said microstrip patch is fed from feed excitation means at two different locations separated angularly by $\phi=\pi/2n$ and at phase quadrature to effect circular polarization of the individual directional beams.

5. The antenna of claim 2, wherein said plurality of antenna elements is provided by a plurality of concentric circular elements in the form of slots having a circumference which is an integer multiple, $n=1,2,3, \ldots N$, of the frequency wavelength, so as to effect resonance in the azimuthal mode for each slot, thereby causing a phase progression of 2n radians for the resonant mode n, along the slot.

6. The antenna of claim 2 wherein said phase shift means introduces phase shifts between excitation of different modes to produce resulting field patterns represented by the relationships:

$$E_\theta = \sum_{n=1}^{N} f_n(\theta)e^{jn\phi}$$

$$E_\phi = \sum_{n=1}^{N} g_n(\theta)e^{jn\phi - j\delta_n}$$

where $\delta_n$ is the phase introduced at the excitation of each mode, whereby when $\phi=\delta_n/n$, the array field maximizes and by employing phase shift values of $\theta$, $\delta_2$, $2\delta_2$, $n\delta_2$. . . at the excitation of each mode, the array beam can be scanned to the direction of $\phi=\delta_2$.

* * * * *